United States Patent [19]

Humphrey

[11] Patent Number: 4,764,030

[45] Date of Patent: Aug. 16, 1988

[54] PART BOTTOM SEAL OF CHAIN OF GUSSETED BAGS AND MACHINE THEREFOR

[75] Inventor: Brian Humphrey, N. Ridgeville, Ohio

[73] Assignee: Basic Packaging Systems, Inc., Avon Lake, Ohio

[21] Appl. No.: 835,722

[22] Filed: Mar. 3, 1986

[51] Int. Cl.[4] ..... B65D 30/20; B31B 23/64

[52] U.S. Cl. ..... 383/120; 383/37; 383/121; 493/193; 493/195; 493/198; 493/233

[58] Field of Search ..... 383/37, 94, 120, 121; 493/193, 194, 195, 196, 197, 198, 233, 234, 238

[56] References Cited

U.S. PATENT DOCUMENTS

| | | | |
|---|---|---|---|
| 2,320,326 | 5/1943 | Avery | 493/197 |
| 2,720,247 | 10/1955 | Richens | 383/120 |
| 3,023,947 | 3/1962 | McDuffie | 383/120 |
| 3,321,354 | 5/1967 | McCutcheon Sloan et al. | 493/196 |
| 3,468,470 | 9/1969 | Sengewald | 229/54 |
| 3,772,116 | 11/1973 | Schaffron | 493/196 |
| 3,896,709 | 7/1975 | Brinkmeier | 493/196 |
| 3,915,077 | 10/1975 | LaFleur et al. | 493/194 |
| 3,961,743 | 6/1976 | Hollowell | 229/62 |
| 3,973,045 | 8/1976 | Brandberg et al. | 426/110 |
| 4,561,107 | 12/1985 | Herder | 383/37 |

FOREIGN PATENT DOCUMENTS

| | | | |
|---|---|---|---|
| 626650 | 10/1961 | Italy | 383/37 |
| 1275399 | 5/1972 | United Kingdom | 383/120 |

*Primary Examiner*—Frederick R. Schmidt
*Assistant Examiner*—William E. Terrell
*Attorney, Agent, or Firm*—Pearne, Gordon, McCoy & Granger

[57] ABSTRACT

A chain of bags is disclosed, with each having first and second panels and gusseted sides. The chain of bags is provided with a transverse bottom seal which in the central portion seals together the front and rear panels, and also seals together the inner portion of the gussets as well as the front and rear panels for four thicknesses being sealed. At the outer portions, there are only two thicknesses sealed together, namely, the front gussets are sealed to the front panel and the rear gussets are sealed to the rear panel. This establishes a chain of bags which may be supplied to a bag filling machine whereat conveyor belts form a nip and grip only the outer portion of the rear gussets where attached to the rear panel. By this means, the bags of a chain may readily be opened to practically full capacity and then filled. When the bag is closed and sealed, it forms a rectangular bag with square ends which may readily be palletized to form a secure and stable pallet load.

14 Claims, 3 Drawing Sheets

PART BOTTOM SEAL OF CHAIN OF GUSSETED BAGS AND MACHINE THEREFOR

BACKGROUND OF THE INVENTION

The prior art has disclosed many different types of bags. A simple bag is a pillow-style with no gussets, either on the sides or at the ends. A further style is one which is side-gusseted and sealed all the way across the ends, called a "pinch-bottom bag," and because of the side gussets, this bag stacks better when laid flat, so that the bags may be stacked, for example, on a pallet for shipping of a group of bags. This bag is shown, for example, in U.S. Pat. No. 3,468,470.

A further style of bag is a square-ended bag which may stand upright, for example, the ordinary grocery bag made of kraft paper. Where this bag is made from plastic film, as a shipping bag, this square-ended bag stacks even better than the pinch-bottom bag when laid flat and stacked on a pallet. Therefore, such bags may be stacked higher on the pallet for shipping. U.S. Pat. No. 3,973,045 shows, in FIG. 5, a pinch-bottom bag with side gussets wherein the bottom has been sealed all the way across, and shows in FIG. 1 a side-gusseted bag wherein only two thicknesses have been sealed everywhere at the bottom, including a central portion and the gusset portions. U.S. Pat. No. 3,961,743 discloses a type of bag which is essentially a square-ended bag, but which has longitudinally extending ears which may be tied together to form a grasping handle.

The side-gusseted, pinch-bottom bag, because it has a bottom seal which extends completely across the width of the bag, is unsuitable for a simple machine for filling the bag. If the bag comes in a chain, such as a zig-zag fold of a series of bags or a roll of a series of bags, then any gripper mechanism to grip the side-gusseted bag would grip the side gussets closed, and hence the bag would be difficult to open and also most difficult to fill completely because the gussets are held closed. If the gripper mechanism were somehow constructed to grip only the gussets along the rear panel, for example, then the bag could open almost completely, but somehow the grippers would have to articulate laterally in and out of the gussets in order to get past the completely sealed-across bottom seal.

SUMMARY OF THE INVENTION

The problem to be solved, therefore, is how to construct a bag in a chain of bags wherein the bag will be essentially a square-ended bag when filled yet the bag is easy to be filled in a practically standard bag-filling machines. An example is a baler bag, which is a large shipping bag in which small product bags are shipped. An example is one-pound to five-pound potting soil bags, which are shipped perhaps 20 to 100 of such small bags in a large baler bag. The prior art practice has been for a workman to hold open the baler bag while another workman loaded the small product bags into this baler bag. Then, the baler bag is closed and sealed, and laid flat on a pallet for shipping. Where the baler bag is a pinch-bottom bag, it does not lie as stable, flat and square on the pallet as a square-ended bag would, since square-ended bags lie flatter and more squarely and securely on a pallet, and hence can be stacked higher and still provide a tighly filled and secure shipping pallet.

This problem may be solved by a chain of bags each having first and second panels and first and second gusseted sides, said first and second gusseted sides each being established by first and second gusset panels integrally joined to said first and second panels, respectively, and joined to each other, and a transverse bottom seal sealing closed the bottom of each bag in the chain, said bottom seal having a central portion with a transverse width less than and substantially centered on the total width of the flattened bag sealing together and said first and second panels of the bag and also contiguous to the central portion sealing together four thicknesses including the first and second panels plus at least the inner portion of the width of said first and second side gusset panels and said bottom seal further having outer portion sealing the outer portions of at least each second gusset panel to said second panel in only two thicknesses along a line substantially colinear to said bottom seal central portion, whereby the bottom of the bag is sealed completely closed and when filled with product open said side gussets to become essentially a square bottom bag.

The problem may further be solved by a bag making machine to make a chain of bags, comprising in combination, means to form a flattened elongated tubular structure with first and second panels, means to form side gussets by first and second side gusset panels at each side of the tubular structure integrally joined to said first and second panels, respectively, and joined to each other, means for form a bottom seal transversely of the flattened tubular structure which seals closed the bottom of the bag, and means to prevent the sealing together of the outer portion of said gusset panels, whereby said bottom seal means together with said preventing means establishes: (a) a sealing together of a central portion of said first and second panels on each bag; (b) contiguous to said central portion of sealing together of four thicknesses which include the first and second panels and at least the inner portions of said first and second side gusset panels; and (c) sealing the outer portion of at least said second side gusset panels together with said second panel in only two thicknesses colinearly with said seal at said central portion.

Accordingly, an object of the invention is to provide a chain of side-gusseted bags wherein a bottom seal is provided which extends throughout the central portion but does not completely seal together the outer portions of the gussets.

Another object of the invention is to provide a chain of side-gusseted bags with a bottom seal, and with four outer portions sealing only the the gusset panels to the front and rear panels of the bag.

A still further object of the invention is to provide a bag-making machine which forms a chain of side-gusseted bags with bottom seals extending transversely of the chain and wherein this bottom seal means includes outer portions which seal only two thicknesses of a part of the gusset and the adjacent front or rear panel.

A further object of the invention is to provide a bag filling machine for a chain of side-gusseted bags which bag machine has grippers to longitudinally move the chain by gripping panel only the rear gusset and a portion of the rear panel.

Other objects and a fuller understanding of the invention may be had by referring to the following description and claims, taken in conjunction with the accompanying drawing.

DETAILED DESCRIPTION OF THE PREFERRED EMBODIMENTS

Figure 1:
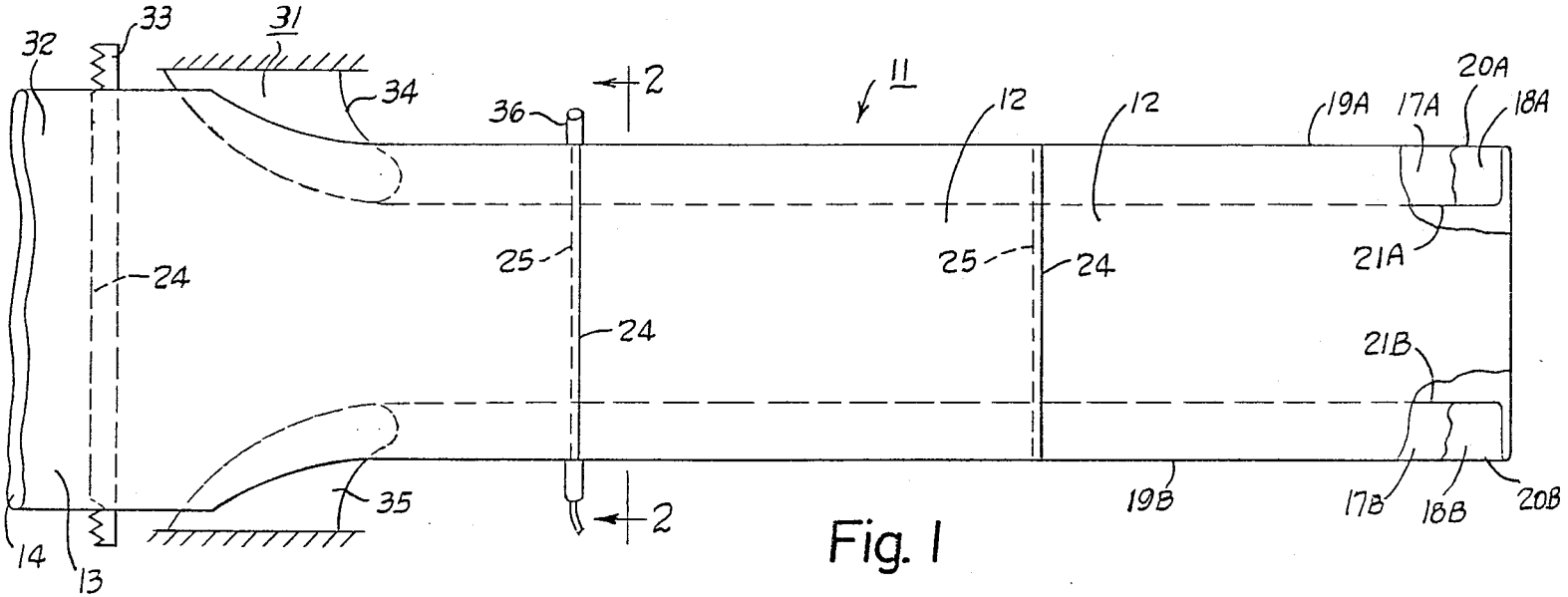
FIG. 1 is a plan view of a bag making machine embodying the invention.

FIG. 1 illustrates a chain 11 of bags 12. This chain of bags has front and rear panels, or first and second panels 13 and 14, and first and second gusseted sides longitudinally extending along the side. On each side, there is a first gusset panel 17A or 17B contiguous with the first panel 13, and there is a second gusset panel 18A or 18B contiguous with the second panel 14. This results in two external fold lines 19A and 19B at the extremities of the front panel 13, and two additional exterior fold lines 20A and 20B at the extremities of the rear panel 14. This also creates interior fold lines 21A and 21B between the first and second gusset panels 17 and 18.

Each bag in the chain has a bottom seal means 24 extending transversely across the chain so as to form the bottom of each of the individual bags 12. The individual bags may be separated from the chain along a line closely adjacent the bottom seal means 24, and to aid in this separation, a perforated tear line 25 is provided along the chain.

Figure 2:
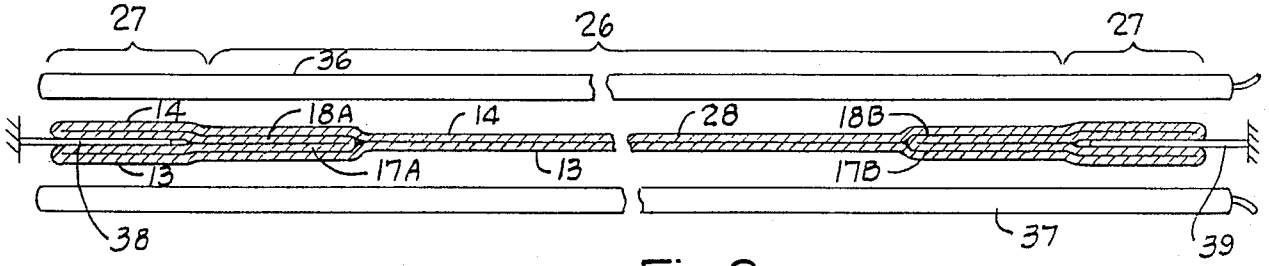
FIG. 2 is an enlarged, sectional view on line 2—2 of FIG. 1, showing the bottom seal apparatus.

The bottom seal means 24 includes a central portion 26 and outer portions 27, as better shown in FIG. 2. The central portion 26 has a transverse width less than the total width of the flattened and gusseted bag 12, and is also centered on this transverse width. The central portion has an intermediate part 28 which seals together only two thicknesses, the first and second panels 13 and 14. The central portion 26, contiguous to the intermediate part 28, further seals four thicknesses at the inner portion of the gussets. The four thicknesses which are sealed together are the first and second panels 13 and 14, together with the first and second gusset panels 17A and 18A. Also at the other lateral side of the central portion 26 and four thicknesses sealed together are the first and second panels 13 and 14 and the first and second gusset panels 17B and 18B. The bottom seal outer portions 27 each seal only two thicknesses, and there are at least two such outer portions which seal the second or rear panel 14 to the second gusset panels 18A and 18B. In the preferred embodiment, there are four such outer portions, and the additional two seal together the first panel and the first gusset panels 17A and 17B.

The bottom seal means extends transversely of the chain of bags 11, and in the preferred embodiment, this is perpendicular to the longitudinal dimension of this chain. This causes the bottom seal outer portions to be directly aligned or colinear with the central portion 26. The outer portions 27 extend for about half the width of the individual gussets, although this may be varied to suit the type of bag and type of bag filling machine, described below. Sufficient width of the gusset panel outer portions is desired so that they may be gripped by grippers, as explained below. When the individual bag 12 is torn from the chain at the tear line 25, this provides an open mouth for the next successive bag in the chain.

FIG. 1 also illustrates, rather diagrammtically, a bag making machine 31 which is capable of making the chain of bags 11. The chain of bags may be made from many different film or sheet materials such as kraft paper, but the preferred embodimet is made from a plastic film. This may be made in sheet form and then folded, with a longitudinal seam to form an elongated tubular structure 32, although in the preferred embodiment, this tubular structure may be formed by extruding a plastic in a tubular form and allowing it to cool, to therefore establish the tubular structure without any longitudinal seam. This tubular structure, after it has cooled, is flattened, and may then be perforated by perforating means 33 to form the peforated tear lines 24. Next, guides 34 and 35 fold inwardly the two sides of the tubular structure to form the gusset panels 17 and 18 and the fold lines 19, 20, and 21. The perforating by the perforating means 33 may be accomplished after the gusseting, but it is often preferred to do it first, since only two thicknesses need be perforated at a time. The moving tubular structure 32 then moves to a bar sealing station whereat heater bars 36 and 37, shown in FIG. 2, may be moved laterally inwardly to engage, heat, and compress together the panels and gussets and seal them together in the structure described above. In FIG. 1, only on such heater bar 36 is shown for clarity. These may be electrically heated bars moved into contact with the plastic film by means not shown. FIG. 2 shows that at the heater bars, shields 38 and 39 are provided between the first and second gusset panels on each side to prevent the outer portions 27 of the first and second gusset panels from adhering to each other. These shields may be of any suitable material, e.g., of Teflon. This establishes that the first gusset panel adheres only to the first panel, and the second gusset adheres only to the second panel, at these outer portions 27. This forms the chain of bags 11, which may then be zig-zag folded into a shipping carton or rolled into a roll for shipping to the location where the bags will be opened and filled.

Figure 3:
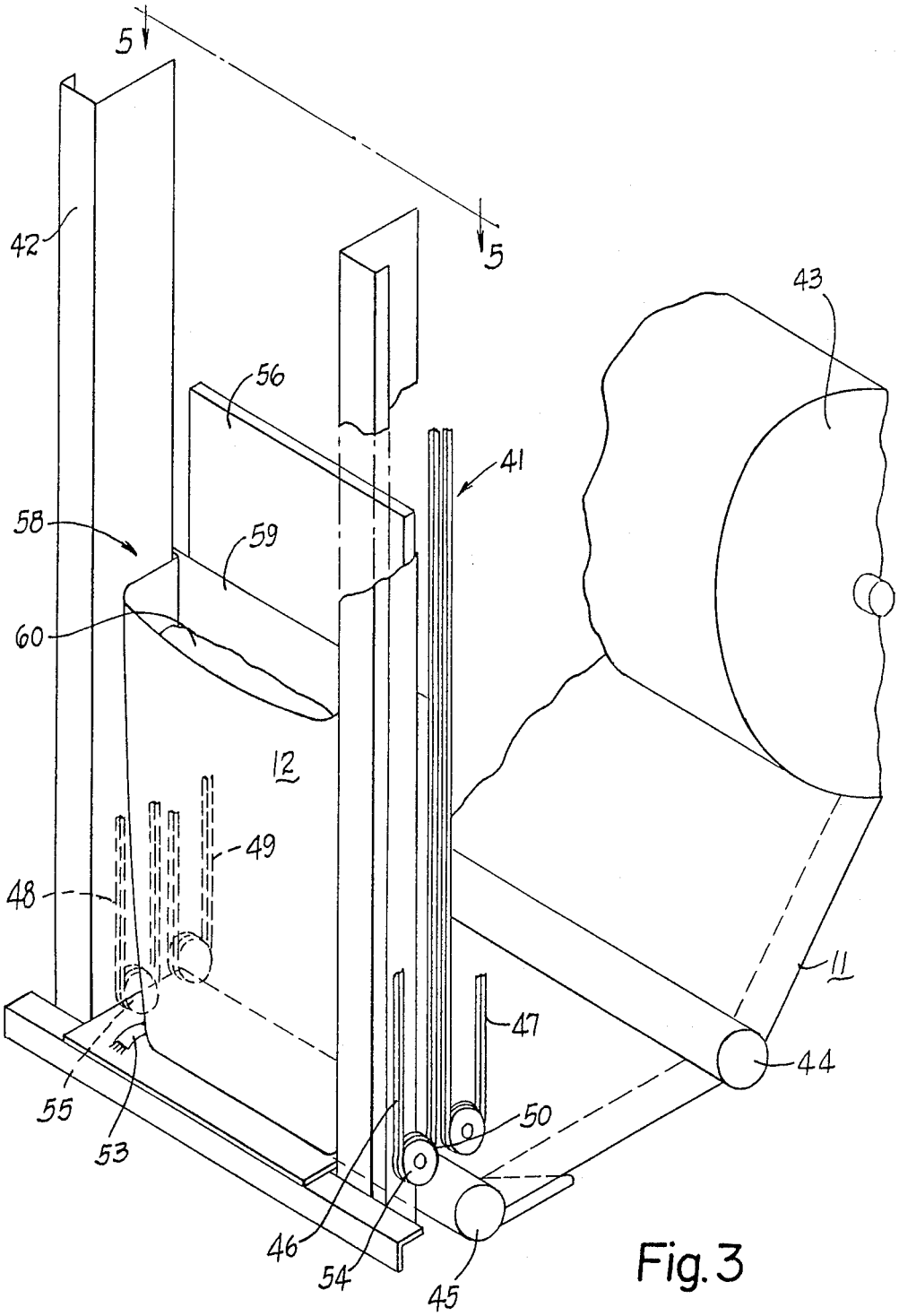
FIG. 3 is an isometric view of a bag filling machine.
Figure 5:
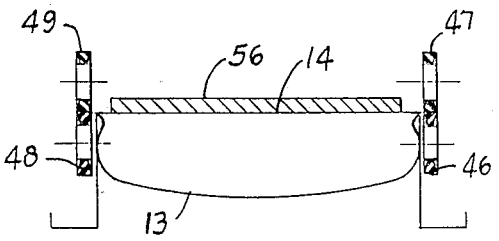
FIG. 5 is a sectional view on line 5—5 of FIG. 3.
Figure 4:
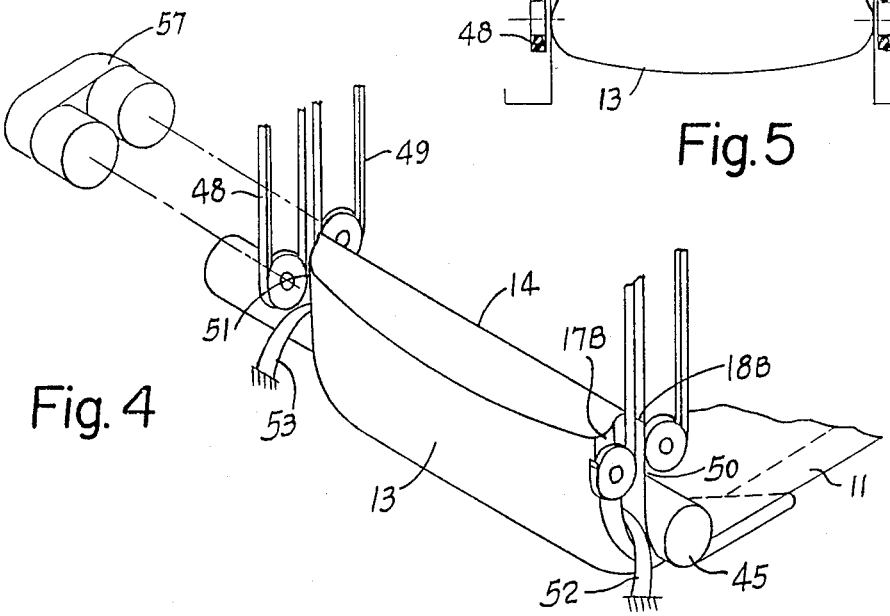
FIG. 4 is a partial view similar to FIG. 3, showing further details.
Figure 6:
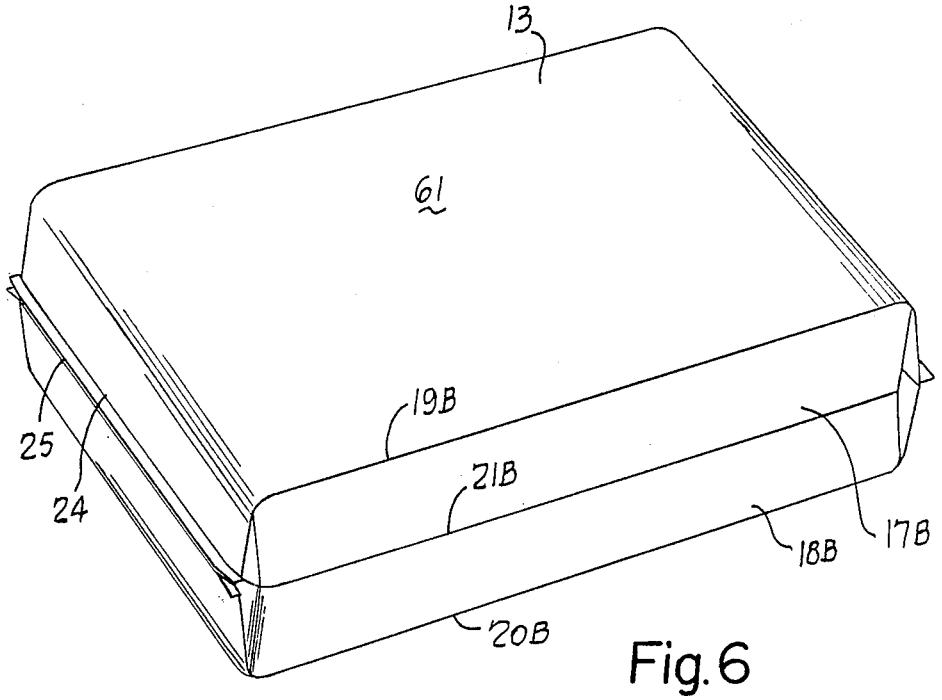
FIG. 6 is an isometric view of a filled and closed bag.

FIGS. 3–5 show a bag filling machine 41 which has a frame 42, shown vertical in this preferred embodiment. The chain of bags 11 is fed from a bulk supply 43 over rollers 44 and 45 to the frame 42. These rollers flatten the tubular structure if not already flattened. Means is provided on the frame 42 to grip the chain of bags and propel them, in this case vertically. This gripper means is shown as first and second pairs of conveyor belts, with belts 46 and 47 being the first pair, and belts 48 and 49 being a second pair. Belts 46 and 47 establish a first nip 50 and belts 48 and 49 establish a second nip 51 at the other side of the frame 42. As better shown in FIG. 4, fingers 52 and 53 are provided closely adjacent the roller 45 to separate the outer portions of the first and second gusset panels. Front bottom pulleys 54 and 55 for the belts may be considered also as means to help open the bags of the chain as they begin to move upwardly by means of the conveyor belts. The nips 50 and 51 grasp only the outer portion of the rear gusset panels and outer portions of the rear panel, and hence keep the rear panel 14 flat and taut laterally and longitudinally. This may be aided by a backboard 56. Drive means 57 provides an indexible drive of the conveyor belts 46–49 to move the chain of bags vertically. In this preferred embodiment, they are moved upwardly to a filling station 58, shown in FIG. 3. At this filling station, the indexible drive means is temporarily halted and the uppermost bag 12 may be filled through the open mouth 59 thereof, either manually or by some automatic means well known to those skilled in the art. In FIG. 3, the uppermost bag 12 has been shown as filled with product 60. This may be bags of products, or may be a loose fill, and the prior art has known many different products which are shipped in bags. The filled bag 61 is then closed, and preferably sealed, by a closing and sealing mechanism well known to those skilled in the art, and removed from the chain of bags. This removal is aided by the perforated tear line 25. FIG. 6 shows the filled bag 61 lying flat, and it becomes practically a rectangular solid because of the square bottom and square top. The square top may be formed by a seal similar to that performed for the bottom seal means, or may be sealed all the way across with four thicknesses at the outer portions. FIG. 6 shows the fold lines 19B and 20B, which are now opened out to become about a 90-degree angle. This figure also shows the fold line 21B, which has now opened out to be practically a straight line. Because the filled bag 61 is rectangular, it may be stacked easily in a stable manner, e.g., on a pallet for shipping. Typically, a shrink wrap is placed over the entire palletized bags. Now it has been found that at least two such palletized groups may be stacked one on top of the other, and still this is a secure and stable palletized load. This is due to the fact that the bags are so nearly a rectangular solid in form instead of being rounded off at the ends, as in a pinch-bottom bag.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

I claim:

1. A chain of bags each having first and second panels and first and second gusseted sides;

said first and second gusseted sides each being established by first and second gusset panels integrally joined to said first and second panels, respectively, and joined to each other; and a transverse bottom seal sealing closed the bottom of each bag in the chain;

said bottom seal having a central portion with a transverse width less than and substantially centered on the total width of the flattened bag sealing together said first and second panels of the bag and also contiguous to the central portion sealing together four thicknesses including the first and second panels plus at least the inner portion of the width of said first and second side gusset panels;

said bottom seal further having outer portions sealing the outer portions of at least each second gusset panel to said second panel in only two thicknesses along a line substantially colinear to said bottom seal central portion, whereby the bottom of the bag is sealed completely closed and when filled with product opens said side gussets to become essentially a square bottom bag.

2. A chain of bags as set forth in claim 1, wherein said bottom seal outer portions are aligned with said bottom seal central portion.

3. A chain of bags as set forth in claim 1, wherein said bottom seal outer portion and central portion extend substantially perpendicularly across the panels.

4. A chain of bags as set forth in claim 1, wherein said bottom seal outer portions are four in number for each bag and further seal the outer portions of each said first gusset panel to said first panel.

5. A chain of bags as set forth in claim 4, wherein said bottom seal outer portion is approximately half the width of each said first and second gusset panel.

6. A chain of bags as set forth in claim 1, wherein said bottom seal outer portion is approximately half the width of each said second gusset panel.

7. A chain of bags as set forth in claim 1, wherein each bag has means aiding separation from the next successive bag in the chain closely adjacent said bottom seal.

8. A chain of bags as set forth in claim 7, including a tear line adjacent each said bottom seal to aid separation of successive bags from the chain.

9. A chain of bags as set forth in claim 8, wherein said tear lines extend across the width of said chain of bags and when torn apart form the open mouth of the next successive bag.

10. A bag making machine to make a chain of bags, comprising in combination:

means to form a flattened elongated tubular structure with first and second panels;

means to form side gussets each being established by first and second side gusset panels at each side of the tubular structure integrally joined to said first and second panels, respectively, and joined to each other;

means to form a bottom seal transversely of the flattened tubular structure which seals closed the bottom of the bag; and means to prevent the sealing together of the outer portion of said gusset panels;

wherein said bottom seal means together with said preventing means establishes: (a) a sealing together of a central portion of said first and second panels on each bag; (b) contiguous to said central portion a sealing together of four thicknesses which include the first and second panels and at least the inner portions of said first and second side gusset panels; and (c) sealing the outer portion of at least said second side gusset panels together with said second panel in only two thicknesses colinearly with said seal at said central portion.

11. A bag making machine as set forth in claim 10, wherein said elongated tubular structure is made from plastic film;

means in said machine to partially perforate transversely across the panels tear lines to eventually be parting lines between successive bags;

each said tear line forming the open top of a bag when the individual bags are separated from the chain of bags; and wherein said bottom seal means and preventing means establish a seal of the outer portion of said first and second side gusset panels to the respective first and second panels in only two thicknesses for each of the four outer portions.

12. A bag making machine to make a chain of bags, comprising in combination:

means to form a flattened elongated structure with face-to-face first and second panels;

means to form side gussets each being established by first and second side gusset panels at each side of the elongated structure integrally joined to said first and second panels, respectively, and joined to each other to form an elongated tubular gusseted structure;

means to form a bottom seal transversely of the flattened tubular gusseted structure which seals closed the bottom of each gusseted bag in the chain; and means to prevent the sealing together of the outer portion of said gusset panels;

whereby said bottom seal means together with said preventing means establishes: (a) a sealing together of a central portion of said first and second panels on each bag; (b) contiguous to said central portion a sealing together of four thicknesses which include the first and second panels and at least the inner portions of said first and second side gusset panels; and (c) sealing the outer portion of at least said second side gusset panels together with said second panel in only two thicknesses colinearly with said seal at said central portion.

13. A bag making machine as set forth in claim 12, wherein said elongated structure is made from tubular plastic film; and means to flatten the tubular structure to form said face-to-face first and second panels.

14. A bag making machine as set forth in claim 12, including means to partially perforate transversely across the panels tear lines to eventually be parting lines between successive bags;

each said tear line forming the open top of a bag when the individual bags are separated from the chain of bags; and wherein said bottom seal means and preventing means establish a seal of the outer portion of said first and second side gusset panels to the respective first and second panels in only two thicknesses for each of the four outer portions.

* * * * *

UNITED STATES PATENT AND TRADEMARK OFFICE

CERTIFICATE OF CORRECTION

PATENT NO. : 4,764,030

DATED : August 16, 1988

INVENTOR(S) : Brian Humphrey

It is certified that error appears in the above-identified patent and that said Letters Patent is hereby corrected as shown below:

Col. 1, line 65, "tighly" should be --tightly--

Col. 2, line 9, delete --and--

Col. 2, line 15, "portion" should be --portions--

Col. 2, line 20, "open" should be --opens--

Col. 2, line 29, delete "for" and insert therefor --to--

Col. 2, line 37 delete "of" and insert therefor --a--

Col. 2, line 63, after"gusset" insert therefor --panel--

Col. 4, line 3, "diagrammtically" should be --diagrammatically--

Col. 4, line 7, "embodimet" should be --embodiment--

Col. 2, line 63, "panel" after "gripping" should be deleted.

Signed and Sealed this

Tenth Day of January, 1989

*Attest:*

*Attesting Officer*

DONALD J. QUIGG

*Commissioner of Patents and Trademarks*